United States Patent [19]

Inoue

[11] 4,351,411

[45] Sep. 28, 1982

[54] SPEAKER DEVICE

[76] Inventor: Kenzo Inoue, 22, Kitatanda, Yabu-machi, Tokai-shi, Aichi-ken, Japan

[21] Appl. No.: 153,703

[22] Filed: May 27, 1980

[30] Foreign Application Priority Data

Aug. 29, 1979 [JP] Japan ..... 54-110693

[51] Int. Cl.[3] ..... H04R 7/14

[52] U.S. Cl. ..... 181/168

[58] Field of Search ..... 181/167–174; 179/115 R, 181 R

[56] References Cited

U.S. PATENT DOCUMENTS 3,111,187 11/1963 Barlow ..... 181/168

3,586,792 6/1971 Gayford ..... 181/167 X 4,132,872 1/1979 Inoue ..... 179/181 R X 4,190,746 2/1980 Harwood et al. ..... 181/167 X

*Primary Examiner*—Joseph W. Hartary

*Assistant Examiner*—Thomas H. Tarcza

*Attorney, Agent, or Firm*—Browdy & Neimark

[57] ABSTRACT

A speaker device which comprises a diaphragm made of synthetic resin. The diaphragm is formed by injection molding and is plated with metal on both surfaces thereof for enhancing the rigidity against bending. The diaphragm is capable of vibrating as a whole, without making a wavy movement in the axial direction as if the entirety were a rigid matter, with a result of producing a loud and clear sound without any distortion or strain.

7 Claims, 3 Drawing Figures

SPEAKER DEVICE

BACKGROUND OF THE INVENTION

This invention relates to an improvement of the tone quality or timbre in a speaker device.

A boom in recent years among audiophiles or high-fidelity fans is so spectacular that the hearers or listeners have developed a sensitive ear. Speaker devices or other instruments in this field are required to be higher and higher in quality. For complying with the requirement for good timbre, all of the parts related to an audio apparatus as a whole, such as the tuner, the amplifier, the speaker device, etc., have to be generally elevated in quality as an entirety. It is not an exaggeration to say that the speaker device where an electric signal is finally converted into a sound (voice) is a key part for attaining the object of the timbre improvement.

The applicant of this invention earlier invented diaphragms or vibrating plates of extremely high rigidity made of a synthetic resin reinforced with fibers and a metallic material, etc. The previous invention has already been patented in the United States as U.S. Pat. No. 4,132,872.

Employment of such a diaphragm or vibration plate of high rigidity makes it possible, in comparison to that of a soft diaphragm made of paper or the like, to produce a highly clear sound and a sound volume comparable to that from a paper cone of nearly three times as large in diameter. And such a diaphragm of high rigidity is capable of producing a sound of broad range of compass covering the whole range of sound from high to low in a single diaphragm. Even such a remarkably improved speaker device still leaves something to be desired.

SUMMARY OF THE INVENTION

The inventor of this invention has empirically noticed that metal plating applied on a diaphragm for the purpose of ornamentation was very effective in enhancing the timbre of the diaphragm.

A diaphragm of synthetic resin, which is essentially low in its Young's modulus no matter how it is reinforced with glass fibers or the like, has been proved to be remarkably improved its rigidity by means of applying metal plating on the surface thereof. An experiment of metal plating of thickness as little as 2–3$\mu$, with an increase of weight in the order of 1 gram, manifested a high degree of effect in rigidity enhancement.

A primary object of this invention which is based on the discovery of the above-mentioned fact is therefore to provide a speaker highly improved in its timbre or tone quality.

Another object of this invention is to provide a speaker of high quality in its timbre at a cost as low as possible.

Other features and objects of this invention will be apparent from the study of the description of the preferred embodiment in conjunction with the appended drawings.

The essence of this invention is to form at least a cone of a diaphragm from a synthetic resin and to apply metal plating on both sides thereof, i.e., face and back.

Out of the structural parts of a diaphragm, that is a cap and cone, the former may be made of a metal, but the latter, a comparably larger part, must be by all means made of a synthetic resin for obtaining a diaphragm light in weight, rigid against bending, and low in cost. It is of course possible to form both from a synthetic resin and also permissible to integrally form the two parts even including a voice coil bobbin in some cases. It is ideal to apply metal plating on the whole of the diaphragm, but it may be limited merely to the cone which most affects the sound quality for enjoying the effect of metal plating.

As for the kind of metals and method of plating, any one of them will do, so long as a metal is suitable and a method is appropriate for being plated firmly on the surface of a synthetic resin plate.

DETAILED DESCRIPTION OF A PREFERRED EMBODIMENT

With reference to the appended drawings an embodiment will be described in detail.

Figure 1:
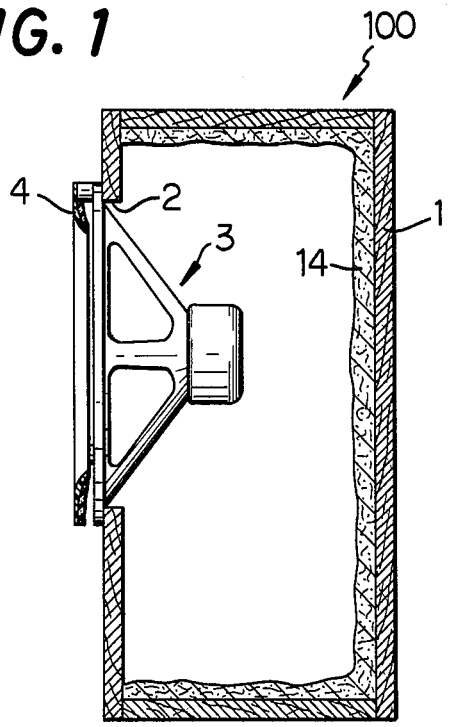
FIG. 1 is a sectional view, cut in a transverse direction, of an embodiment of this invention seen from a side thereof.

In FIG. 1 numeral 1 designates a closely sealed wooden box, a kind of baffle, and the interior surface thereof is covered with a sound absorbing material 14. To an opening portion 2 formed in the front side of the closely sealed wooden box 1 a speaker 3 is attached in such a manner as to just cover the opening portion 2 and a sheltering or shading plate 4 is firmly fixed to the front side of the speaker 3.

Figure 3:
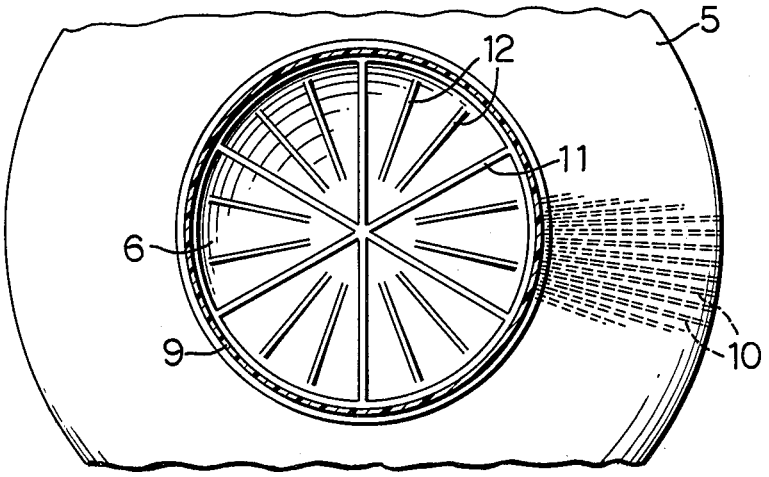
FIG. 3 is a cross sectional view taken along the section line of III—III in FIG. 2.
Figure 2:
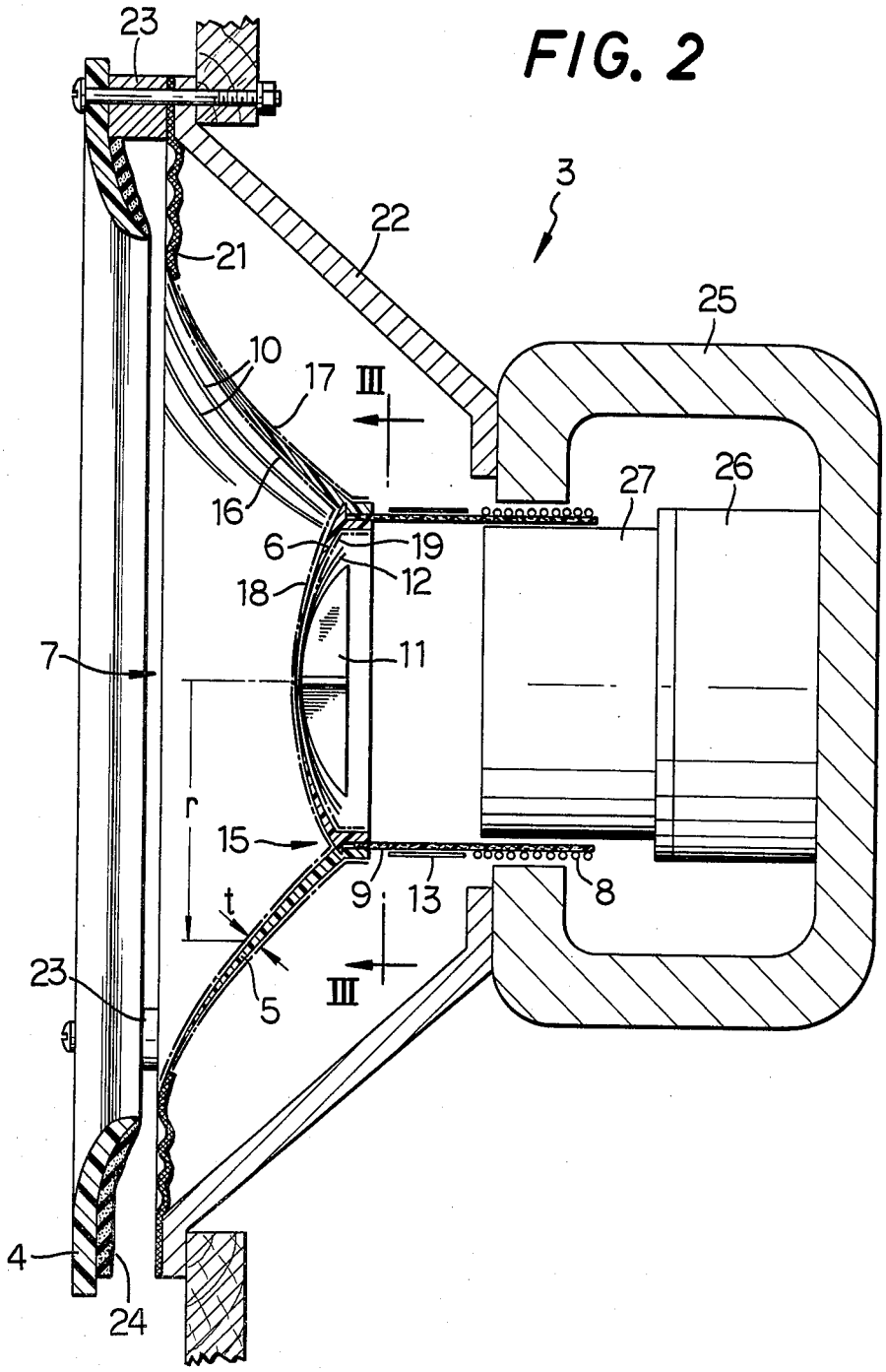
FIG. 2 is an enlarged sectional view, cut in a transverse direction, of an essential part of the embodiment in FIG. 1.

The speaker 3 is provided, as shown in FIG. 2 in an enlarged view, with a vibrator or vibration body 15 which consists of a diaphragm 7 or a vibrating plate, which is composed of a cap 6 of dome shape (dome portion) and a cone portion 5 of funnel shape, and a bobbin 9 of cylindrical shape secured to the diaphragm 7. The cone portion 5 of the diaphragm 7 is a body made of a fiber reinforced thermoplastic resin (FRTP) by injection molding method into a substantially truncated conical shape and provided on its interior surface (and possibly also on its exterior surface) with a number of radial ribs 10. The wall thickness t of the cone portion 5 is preferably gradually decreased from the central portion toward the periphery thereof. In this embodiment the average wall thickness is approximately 0.5 mm and the minimum wall thickness near the periphery is made 0.3 mm or so; and the way of decreasing the thickness from the central portion toward the periphery is determined such that product of a radius r as measured from the center of the cone portion 5 multiplied by the thickness t at the point of the radius r, i.e., r.t is gradually decreased from the center toward the periphery. The dome portion 6 of the diaphragm 7 is a circular plate member of dome shape frontwardly convex; the wall thickness thereof is made gradually thinner toward the central portion. On the back surface of the dome portion 6 a number of ribs 11, 12 are radially formed, as most clearly illustrated in FIG. 3. The ribs 11 are generally large in height and made gradually higher toward the central portion of the dome for being connected to each other at the center of the dome portion 6. The ribs 12 are on the other hand small in height and arranged such that a pair of ribs 12 is disposed in each sector defined by two neighboring higher ribs 11. The dome portion 6 is, similarly to the cone portion 5, formed by injection molding of an FRTP. The bobbin 9 is a cylindrical body of paper impregnated with a resin, and on one end portion thereof a voice coil 8 is wound about.

Both sides, i.e., face and back (front and rear), of the cone portion 5 and both sides of the dome portion 6 are respectively covered with metal plating layers 16, 17 and 18, 19. In this instance the diaphragm 7, composed of a cone portion stuck to a dome portion with epoxy resin, is plated with copper Cu to a thickness of 2.0μ followed by a replating with chromium Cr to a thickness of 1.2μ. By this plating the weight of the diaphragm 7 was increased by approximately 1 g, from 16 g to 17 g. The bobbin 9 is, on the opposite end from that where the voice coil 8 is wound, reinforcedly supported by a cylindrical aluminum body 13 of thin wall and connected to the diaphragm 7 with epoxy resin to be an integral body as an entirety therewith.

The diaphragm 7 is, via an edge 21, attached to a frame 22. The edge 21 is a ring body of a cloth having wavy pattern of undulation in the circumferential direction thereof for increasing the flexible capability thereof; it is adhered at the internal portion thereof to the external portion of the diaphragm 7 with an adhesive and adhered similarly at the external portion thereof to the front surface of a flange portion of the frame 22. By the edge 21 of ring shape the diaphragm 7 is connected to the frame 22 in a lightly movable manner in the axial direction of the diaphragm 7.

On the front side of the edge 21 the shading plate 4 is firmly fixed, which is an annular plate member of synthetic resin with a metal plating layer on both sides thereof for enhancing the rigidity. The shading plate 4 is fixed to the frame 22, with a plurality of spacers 23 being arranged at an equal pitch or interval and in a sandwiched manner between itself and the frame 22. The shading plate 4 covers, when it is seen from the front side of the speaker device 100 as a whole, almost the whole surface of the edge 21 (the whole surface in this instance means the entire surface excepting the attached portion of the edge 21) and further extends for projecting outwards beyond the brim of the frame 22. It is also formed in a gradually approaching shape to the edge 21, as from the external portion to the internal portion thereof, but a small gap must be left at the internal edge thereof between the two members even when the amplitude of the diaphragm is the maximum. On the interior surface of the shading plate 4 a sound absorbing material 24 of foamed rubber or the like is stuck.

On the rear end of the frame 22 a yoke 25 is fixed, with a permanent magnet 26 being secured to the inside surface thereof in the central position. On the front end of the permanent magnet 26 a pole 27 is fixed. The afore-mentioned voice coil 8 is inserted into a magnetic field formed between the inner peripheral surface of the yoke 25 and the outer peripheral surface of the pole 27.

When a signal current is applied in the voice coil 8 of the speaker device 100 of such a structure, the vibrator 15 composed of the bobbin 9 and the diaphragm 7 is vibrated in the wake of the signal to produce a sound. Then the sound is a beautiful one without any distortion or strain. The vibrator 15, particularly the diaphragm 7, is covered on both sides thereof with a metal plating layer, with a result of largely enhancing the rigidity against bending because of sandwiching a relatively low material (FRTP) in the Young's modulus with the two plating layers of metal high in Young's modulus. The diaphragm 7 is consequently capable of vibrating as a whole, without making a wavy movement, in the axial direction as if the entirety were a rigid matter. It can therefore produce a loud and clear sound.

The application of metal plating has produced a supplementary effect, in addition to the imparting of rigidity against bending to the diaphragm 7, of giving strength against breakage. It has eliminated a disadvantage of susceptibility to the appearance of a crack in a portion near the periphery of the same.

The metal plating layer is also effective in enhancing durability of the diaphragm 7 of synthetic resin. The diaphragm 7 is made so thin that it is liable to be deteriorated in strength when it is exposed at the synthetic resin surface thereof to ultraviolet rays. The life of the diaphragm 7 has been largely extended by being covered with plating layers.

It is of course another good effect to have improved the appearance of the diaphragm by the metal plating, from the standpoint of ornamentation. It is still another effect that the cone and others can be easily handled in formation process due to the plating. In the conventional way of manufacturing a diaphragm, even synthetic resins relatively difficult in formation process have been obliged to be adopted so as to maintain the high rigidity and high strength of the resins. The remarkable improvement of rigidity and strength of the resins by the metal plating has largely expanded the sphere of free choice of the synthetic resins even to less rigid and strong ones, so long as they are suitable for formation process, because the rigidity and strength can be fully covered by the metal plating. Decreasing of the mixing ratio of reinforcing fibers or even a complete eliminating of the fibers has become possible. Synthetic resins easy in forming are usually low in rigidity and at the same time low in specific gravity. It is therefore allowed for resins of such low specific gravity to be given thicker metal plating, by the corresponding amount of the less weight due to the smaller specific gravity thereof, for obtaining a diaphragm of high rigidity.

It is of course possible to use thermosetting resins for the diaphragm according to this invention.

As mentioned above in detail, a speaker device in accordance with this invention has realized a great improvement in generating a clear sound of good timbre which is characteristically produced by a vibrator of high performance by merely adding a simple process of applying metal plating at least to the both side surfaces of a cone which is a part of a diaphragm integrally vibrating in the wake of a signal current.

What is claimed is:

1. A speaker device comprising a diaphragm including a cone portion of synthetic resin material which is reinforced for increased rigidity with a number of circumferentially space, radially extending, integrally formed ribs, said cone portion having an average wall thickness on the order of tenths of a millimeter, and means for improving the sound reproducing capability of said speaker device and for improving the speaker device's resistance to deterioration from exposure to ultraviolet light comprising at least one layer of metal plating on all of the inside and outside surfaces of said cone portion; whereby said cone portion is given further enhanced sound reproduction capability by said at least one layer of metal plating.

2. A speaker device as recited in claim 1, wherein said cone portion is injection molded.

3. A speaker device as recited in claim 1, wherein said at least one layer of metal plating is two plating layers of first copper and then chromium one on top of the other.

4. A speaker device as recited in claim 1, wherein said synthetic resin material is a thermosetting resin.

5. A speaker device as recited in claim 1, wherein said synthetic resin material is a thermoplastic resin.

6. A speaker device as recited in claim 1, wherein each of said at least one layer or metal plating has a thickness on the order of thousandths of a millimeter.

7. A speaker device as recited in claim 1, wherein said cone portion is provided with an integrally formed dome-shaped portion which includes a wall curved convex frontwardly of said cone portion and filling an inner central opening of said cone portion.

* * * * *